United States Patent [19]

Poe

[11] Patent Number: 4,745,783

[45] Date of Patent: May 24, 1988

[54] TAMPER PROOF PADLOCK HASP APPARATUS

[76] Inventor: Lloyd R. Poe, 7341 S. Marina Pacifica Dr., Long Beach, Calif. 90803

[21] Appl. No.: 67,538

[22] Filed: Jun. 29, 1987

[51] Int. Cl.[4] ..... E05B 67/38; E05C 19/08

[52] U.S. Cl. ..... 70/2; 70/54; 292/281

[58] Field of Search ..... 70/2–12, 70/54–56; 292/281–286

[56] References Cited

U.S. PATENT DOCUMENTS

| | | | |
|---|---|---|---|
| 1,554,592 | 9/1925 | Olson . | |
| 3,392,555 | 7/1968 | Beaver . | |
| 3,460,861 | 8/1969 | Niilola | 292/281 |
| 3,606,423 | 9/1971 | McCarthy . | |
| 3,652,114 | 3/1972 | Cady . | |
| 3,727,438 | 4/1973 | Knaack . | |
| 3,736,016 | 5/1973 | Garvey et al. . | |
| 3,744,280 | 7/1973 | Brown . | |
| 3,800,570 | 4/1974 | Kaplan . | |
| 3,858,923 | 1/1975 | Bunn | 292/281 |
| 3,884,057 | 5/1975 | Maurer . | |
| 4,106,315 | 8/1978 | Dohanyos . | |
| 4,141,232 | 2/1979 | Kelly . | |
| 4,157,653 | 6/1979 | Dohanyos . | |
| 4,322,102 | 3/1982 | Lindblom | 292/281 |
| 4,581,907 | 4/1986 | Eberly . | |

*Primary Examiner*—Robert L. Wolfe

*Attorney, Agent, or Firm*—Fulwider, Patton, Rieber, Lee & Utecht

[57] ABSTRACT

A tamper proof hasp apparatus for use with a conventional padlock incorporating a U-shaped attached shackle pivotable, when unlocked, about a shackle pivot leg. The apparatus includes first and second hasps incorporating respective first and second hasp plates formed on one end with an opening for receipt laterally thereinto of the pivot leg of the shackle and formed on the opposite end with bores for receiving the closure leg of such shackle. The closure bore of the first plate is of such a diameter as to receive the closure leg of the hasp and to engage the curved portion thereof to limit the extent to which such hasp may be inserted. The respective hasps are formed with guard plates projecting laterally thereof to, when such hasps are mounted on respective parts to be locked together, restrict access to such shackle by tampering tools such as bolt cutters, hacksaws and the like.

15 Claims, 2 Drawing Sheets

FIG. 1
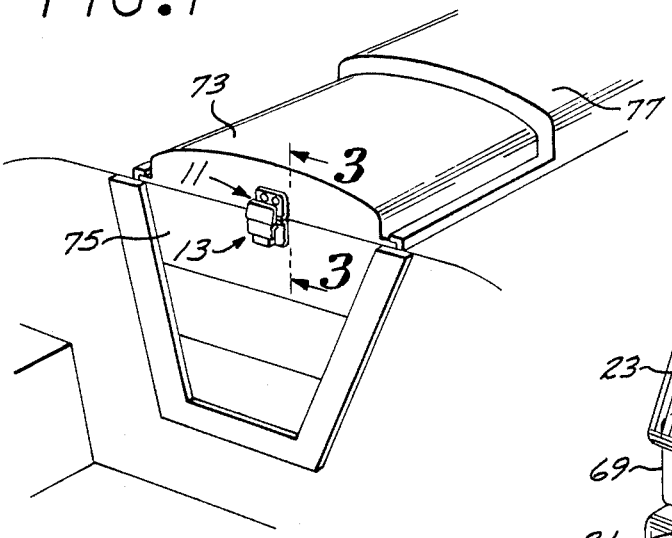
FIG. 2
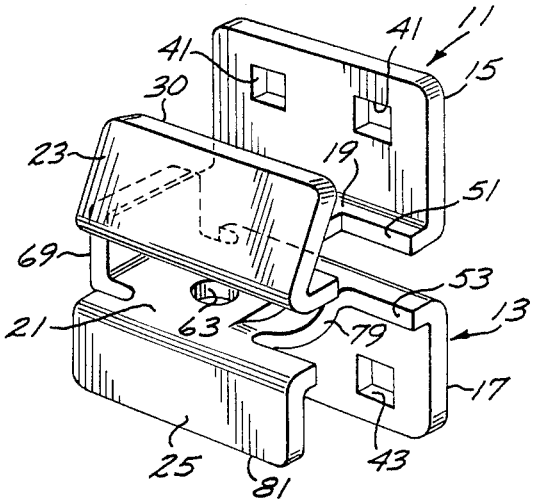
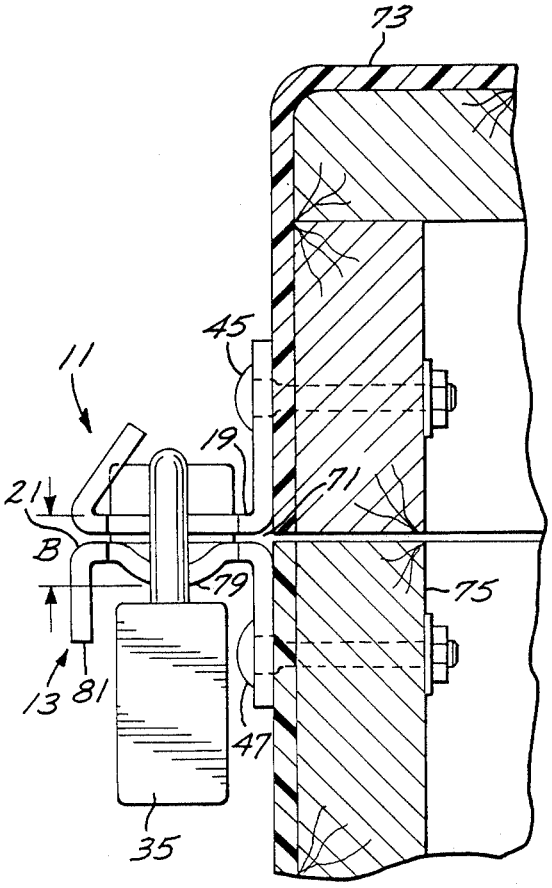
FIG. 3
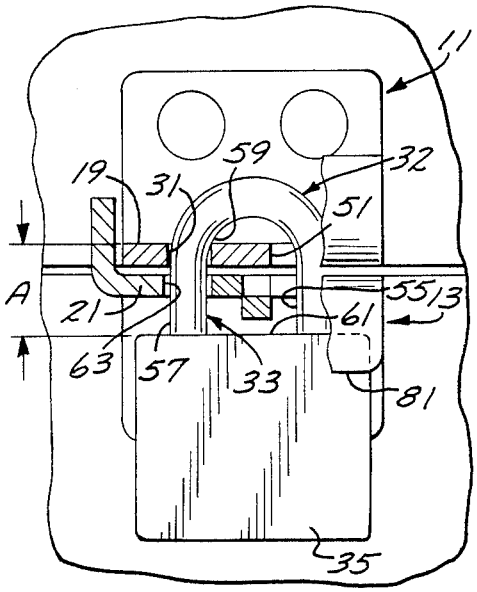
FIG. 4

TAMPER PROOF PADLOCK HASP APPARATUS

BACKGROUND OF THE INVENTION

1. Field of the Invention:

The present invention relates to hasps which receive padlocks to lock the hasp parts together.

2. Description of the Prior Art:

Padlocks are typically utilized to lock separable parts, such as doors, gates, covers and lids in their closed positions to secure the contents from unauthorized personnel. A major threat to such security are modern day bolt cutters which provide a high degree of mechanical advantage enabling intruders to quickly and quietly cut through the shackles of conventional padlocks. Efforts to defeat or hinder the effectiveness of such bolt cutters have led to the development of costly oversized padlocks incorporating shackles of increasing size, hardness and toughness. Thus, there exists a need for a padlock hasp apparatus which will guard the padlock shackle from access by conventional tamper tools and allow the use of conventional padlocks.

It is also a shortcoming of prior art hasps that the hasps themselves often form the weaker and more vulnerable link in the security system. Some such hasps incorporate a relatively long pivotal strap formed with a slot for receipt over a staple retainer, which strap itself may be easily pried loose. The hasp staples provided for use with oversized padlocks are generally softer and weaker than the shackle of the padlock, thus totally defeating the effectiveness of the padlock.

Efforts to solve these long standing problems has led to the development of different styles of hasps intended to be used with either conventional padlocks having pivoting attached shackles or specially designed padlocks to minimize the risk of unauthorized entry. One such hasp incorporates an U-shaped hasp member mounted on a box for mating with a second hasp member mounted on a lid. The first and second hasp members, when closed, are intended to cooperate in forming a shroud around the padlock and its shackle to restrict direct access to such shackle. A device of this type is shown in U.S. Pat. No. 3,727,438 to Knaack. Such hasps, while being satisfactory for their intended use on a specific part, suffer the shortcoming that they cannot be applied to a variety of parts where the opening geometry varies drastically, such as hinging versus sliding closures. Other shortcomings are that the hasp parts are bulky, require padlock installation before closure of the parts on one another, inhibit padlock operation, and do not incorporate a mounting arrangement which would prevent fastening screws or bolts from being removed by an intruder.

Other efforts have led to the development of hasps for use with padlocks having shrouds projecting upwardly from the body thereof on opposite sides of the shackle. The hasp then incorporates a hood which is intended to cooperate with the shrouds to block access to the shackle. A device of this type is shown in U.S. Pat. No. 3,652,114 to Cady. While satisfactory for the intended use, such hasps suffer the shortcoming that they require use with padlocks of special design and result in an expensive combination which has limited application and is cumbersome to lock and unlock.

It is an object of the present invention to overcome the shortcomings of these prior art devices and to provide a hasp which accommodates conventional padlocks of appropriate size, has great flexibility for mounting in numerous part configurations, does not inhibit padlock operation, and which occupies a relatively small mounting area and affords an attractive appearance.

Other objects are to provide a hasp which will hinder direct access to a padlock shackle with quick, silent tools such as a bolt cutter and has no movable protuberances which might result in risk of injury to users.

SUMMARY OF THE INVENTION

The apparatus of the present invention is characterized by first and second hasps incorporating mounting plates for mounting on parts to be locked together and including coextensive first and second hasp plates formed on their respective one ends with laterally extending openings for receipt of the pivot leg of a padlock shackle and formed on their respective opposite ends with a bore for receipt of the closure leg of such shackle. Mounted on one or the other, or both, of the hasp plates is a guard plate which projects longitudinally of the shackle to independently form a box like structure restricting access to the shackle. When the padlock is locked, travel of the shackle in one direction relative to the hasp plates is limited by contact of the padlock housing with one of the plates and travel in the other direction limited by engagement of the curved end of the shackle with the other of the plates.

Other objects and features of the invention will become apparent from consideration of the following description taken in connection with the accompanying drawing.

BRIEF DESCRIPTION OF THE DRAWINGS

FIG. 1 is a perspective view of a padlock hasp incorporating my invention;

FIG. 2 is an enlarged perspective view of the padlock hasp apparatus shown in FIG. 1;

FIG. 3 is a vertical sectional view, in enlarged scale, taken along the line 3—3 of FIG. 1;

FIG. 4 is a front view, partially broken away, of the hasp apparatus shown in FIG. 3;

DESCRIPTION OF THE PREFERRED EMBODIMENT

Figure 5:
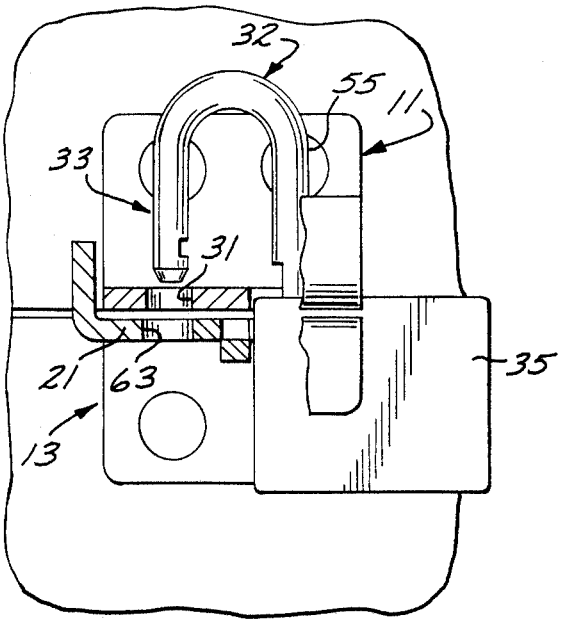
FIG. 5 is a front view similar to FIG. 4 but showing the unlocked padlock being inserted into the hasp apparatus.

Referring to FIGS. 2 and 3, the preferred embodiment of the hasp apparatus of the present invention includes, generally, first and second hasps 11 and 13, respectively, each of generally U-shaped construction disposed in back to back relationship. One leg of each respective hasp forms a respective planar vertical mounting plate 15 and 17, and the closed end of each respective planar horizontal hasp plates 19 and 21, and the opposite legs of each, vertical guard plates 23 and 25. The upper hasp plate is formed with a vertical bore 31 which receives the vertical shackle closure leg 33 of a padlock, generally designated 35, insertion downwardly into such bore 31 being limited by the curvature of the shackle, generally designated 32. The overall length of the guard plates 23 and 25 are such that the shackle 32 is protected from access thereto by bolt cutters, it being appreciated that upward shifting of the locked padlock is limited by engagement of the body with the underside of the plate 21 and downward travel thereof being limited by the curvature of the shackle.

The upper and lower hasps 11 and 13 may be constructed of high tensile metal and are shown in the preferred embodiment with the generally U-shaped configuration. The mounting flanges 15 and 17 are generally rectangular and conveniently formed with spaced square mounting openings 41 and 43, respectively, for receipt of the shoulder of respective carriage bolts 45 and 47 (FIG. 3). The hasp plates 19 and 21 are formed at their respective one end with respective slots 51 and 53 which open to the ends opposite the bore 31 for convenient receipt laterally thereinto of the pivot leg 55 of the padlock shackle 32 (FIG. 4). The guard plates 23 and 25 are generally rectangular, the upper plate 23 being angled inwardly and upwardly from the free edge of the hasp plate 19 to terminate in a top edge 30 spaced from the mounting plate 15 a distance less than the thickness of the padlock body. This, in addition to blocking access to the shackle 32 from above, serves to prevent installation of the padlock in its inverted position and to prevent rotation of the properly locked padlock to its inverted position, which inverted position may expose the shackle for access by bolt cutters.

It will be appreciated that padlocks 35 are formed in many different sizes and shapes. However, many padlocks fall into, for instance, two or three size categories, each category of which are characterized by padlocks incorporating shackles 32 which are of somewhat uniform standard diameter and have relatively uniform radii for the closed end thereof. It is these features which I have taken advantage of in constructing my new invention. The closure leg-receiving bore 31 in the upper hasp plate 19 is sized such that the peripherally outer surface 57 engages the outside peripheral wall of such bore (FIG. 4) causing the inside curvature of the shackle 32, as such shackle is lowered, to engage the inside top edge of that bore at a point which I refer to as a bearing point 59 (FIG. 4). The distance A (FIG. 4) between the bearing point 59 and top surface 61 of the padlock thus establishes a critical distance which serves as an important factor in defining the overall length which must be afforded the guard plates 23 and 25 to provide an effective guard for the shackle 32 as to be described hereinafter.

A closure leg-receiving bore 63 is formed in the lower hasp plate 21 and is disposed in vertical alignment with the upper bore 31 but is of a slightly larger diameter thus minimizing any critical alignment between the two bores. It will be appreciated that downward travel of the shackle 32 may, in the alternative, be limited by the spacing between the bore 31 and slot 51. However, I have determined that this travel limitation may be advantageously achieved in the manner first described above.

The bottom plate 21 is formed with a downwardly protruding lanced spacer dimple 79 adjacent the slot 53 (FIG. 2) which serves to limit upward shifting of the padlock body 35 for a purpose which will appear hereinafter. It will be appreciated that the spacing between the bores 31 and 63 of the respective slots 51 and 53 is such as to accommodate the spacing between the legs 55 and 57 of the shackle 32.

Referring to FIGS. 2 and 3, the bottom hasp 13 is formed on the end opposite the slot 51 with an upturned guard tab 69 which projects in overlying relationship with the opposed end of the upper hasp plate 19 to block access to the gap 71 (FIG. 3) formed between the plates 19 and 21 when in their mounted positions. This restricts access via that gap to the hasp 32 by such mechanisms as hacksaw blades and the like.

Referring to FIGS. 1 and 3, it will be appreciated that one particularly useful application of the hasp apparatus of the present invention is for locking the hatch cover 73 to the top hatch board 75 of a sailboat 77 to secure the interior of the boat against entry. For this application I have found it convenient to mount the hasps 11 and 13 in the position shown in FIG. 3. The round headed bolts 45 and 47 thus restrict access thereto from the exterior by means of screwdrivers, pliers and wrenches.

The hasps 11 and 13 are mounted in a configuration with a slight gap 71 between the respective hasp plates 19 and 21 to thus allow for relative movement between the hatch board 75 and cover 73 and to allow for expansion and contraction of the cover and board due to weather change and wear while restricting access through such gap to the shackle. This mounting of the hasps with such plates spaced apart then establishes the dimension B (FIG. 3) between the top surface of the upper plate 19 and lowermost surface of the dimple 79. This distance then plays an important role in limiting the amount of vertical travel of the shackle 32 while the padlock is in its locked position.

In operation, when it is desirable to lock the hatch 73, it is drawn to its closed position shown in FIG. 1 to bring the hasps 11 and 13 into vertical alignment over one another. The padlock 35 may then be easily installed by unlocking it and raising the shackle 32 to its fully extended position shown in FIG. 5. With the shackle so positioned, the pivot leg 55 may be shifted laterally inwardly into the slot 53. It will be appreciated that in the preferred embodiment the slots 51 and 53 have sufficient width to accommodate the width of the padlock body 35 such that the body may be rotated about the pivot leg to the full open position shown in FIG. 5 to have the upper near corner of the body received therein. In other configurations contemplated for the present invention, the slots 51 and 53 may have a width sufficient only to accommodate the diameter of the shackle 32. If desired, for particular configurations, the body padlock 35 may be canted to accommodate insertion of the closure leg 33.

Figure 6:
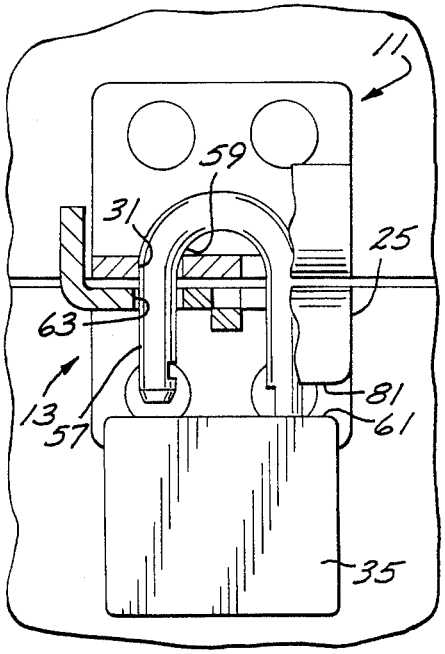
FIG. 6 is a front view similar to FIG. 5 but showing the padlock more fully inserted.

With the shackle closure leg 33 aligned over the upper closure hole 31 it may be lowered vertically downwardly therein to be inserted through the lower closure bore 63 of the lower plate 21 to cause the bearing point 59 at the closed end to come to rest on the edge defined by the inside wall of the such bore 31. In its fully lowered position, with the padlock remaining unlocked and the shackle fully extended, it will be appreciated that the top surface 61 of the body 35 will clear the lower edge 81 of the lower guard plate 25 thus enabling the body 35 to be rotated 180 degrees on the pivot leg 55 from the position shown in FIG. 5 to the position shown in FIG. 6. In this regard, it will be appreciated that the vertical mounting and guard plates 17 and 25, respectively, are spaced apart a sufficient distance to enable the width of the padlock body to be received upwardly therebetween. Thus, the padlock body 35 may be shifted upwardly on the legs 33 and 55 to lock the body onto a shackle as shown in FIG. 4.

In this condition, it will be appreciated that access to the shackle 32 is extremely limited. That is, the lower edge of the lower guard plate 25 projects downwardly a distance beyond the top surface 61 of such body as shown in FIG. 4 such that access to the lower part of the shackle by, for instance, the nose of a conventional bolt cutter is positively blocked. Likewise, any effort to raise the body 35 of the padlock to elevate the top closed end of the shackle 32 above the top edge of the upper guard plate 23 is restricted by the top surface 61 contacting the dimple 79 thus positively blocking further upward shifting thereof to a point where it is still guarded by the upper guard plate 23. It will be appreciated that the guard plate 23, being angled upwardly and inwardly, affords even greater restriction to access thereto by the nose of the jaws of a bolt cutter. In essence the guard plates by projecting coextensive with the entire length of the shackle 3 throughout the entire path of its travel, while locked, positively blocks access thereto for the purpose of tampering. The horizontal distance between vertical mounting plates 15 and 17, of first and second hasps 11 and 13, and vertical guard plates 23 and 25, respectively, is restricted to prevent entry of a bolt cutter tool from above or the ends. Alternatively, in other hasp configurations, as in configurations where the mounting plates 15 and 17 and respective hasp plates 19 and 21 are planar, the distance between the surfaces of the product upon which the hasp is mounted, and respective guard plates 23 and 25, are similarly restricted.

Similarly, the guard tab 69 affords a restriction against full length hacksaw blade being brought into position within the gap 71 between the plates 19 and 21 to saw the shackle 32.

Figure 7:
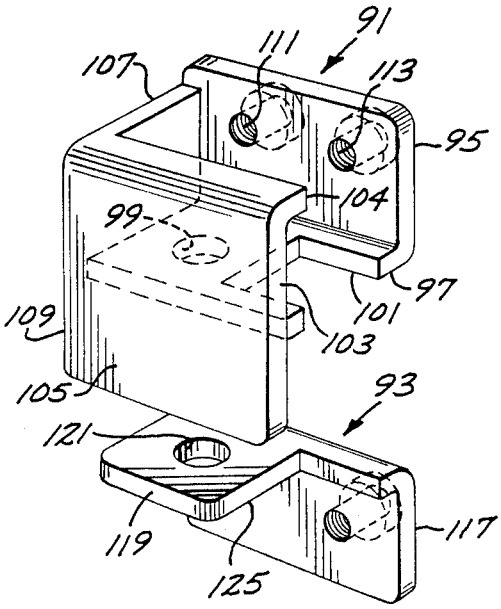
FIG. 7 is an exploded perspective view of a second embodiment of the hasp apparatus of the present invention.
Figure 8:
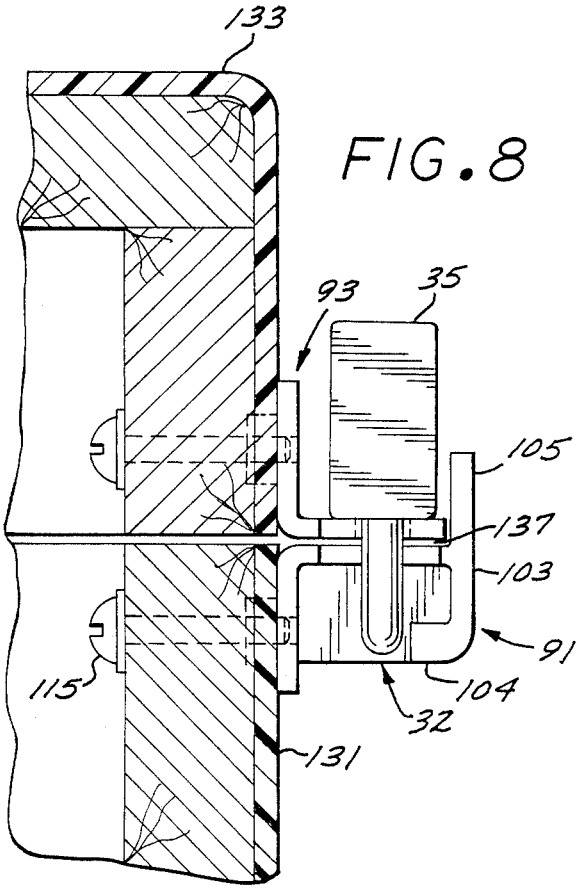
FIG. 8 is a sectional view, similar to FIG. 3, but showing the hasp of FIG. 7 installed and locked.

Referring to FIGS. 7 and 8, the second embodiment of the hasp apparatus of the present invention incorporates first and second hasps, generally designated 91 and 93. The first hasp has somewhat of a box-like construction and incorporates a vertical mounting flange 95 and horizontal hasp plate 97. The mounting flange 95 is formed with threaded bosses 111 and 113 for receiving the threaded shanks of respective mounting screws 115 (FIG. 8). The hasp plate 97 incorporates the closure leg receiving bore 99 and open ended pivot leg receiving slot 101. Mounted across the front and side of the hasp plate 97 is a vertical guard which incorporates an upwardly projecting first guard plate 103 and downwardly projecting second front guard plate 105 spaced horizontally from the mounting plate 95 for blocking access to the padlock shackle. This guard plate 103 is formed at its free end with an inturned flange 104 which restricts access to the closed end of the padlock shackle 32 (FIG. 8). Vertical guard plates 107 and 109 mounted at the end of the hasp plate 97 opposite the slot 101 serves to block access from that end of the hasp and also to the gap 137 between the hasps 91 and 93 when in their mounted positions.

The second hasp 93 is of L-shaped construction and incorporates a vertical mounting flange 117 and horizontal hasp plate 119 formed with a bore 121 for vertical alignment with the bore 99. A cutout 125 is formed in such plate 119 for receipt of the padlock body 35 during installation.

Referring to FIG. 8, in this construction, it will be appreciated that it is necessary to mount the hasp 91 in its inverted position to the hatch boards 131 and the hasp 93 to the sliding hatch cover 133 so that the guard plate 105 will not restrict rearward sliding of the hatch cover 133. In this installed condition, it will be appreciated that the guard plate 105 overlies the front edge of the hasp plate 119 and projects upwardly a distance sufficient to restrict access to the shackle 32. Likewise, the guard plate 103 projects downwardly a sufficient distance to restrict access to the closed end of the shackle 32. The inturned flange 104 further limits the size of the downward opening to thus further restrict access to the shackle.

The end plates 107 and 109 afford further restriction against access and the plate 109 covers the end of the gap 137 (FIG. 8) formed between the plates 97 and 119 to thus restrict access thereto by a hacksaw blade or the like.

From the foregoing it will be appreciated that the hasp apparatus of the present invention provides an economical and inexpensive means for restricting access to a padlock shackle. The hasp apparatus is relatively compact, convenient to install and allows for the use of a conventional padlock.

Various modifications and changes may be made with regard to the foregoing detailed description without departing from the spirit of the invention.

I claim:

1. Padlook hasp apparatus for receiving a padlock for locking first and second parts together and including a padlock body formed with a top surface and mounting an inverted U-shaped padlock shackle of a predetermined cross sectional diameter and formed on its closed end with a loop of a selected inside radius and having oppositely disposed, generally straight, pivot and capture legs, the longitudinal dimension between a bearing point on the inside surface of such capture leg as it turns into such loop being located, when said shackle is in its locked position, a predetermined distance from such top surface of the padlock body, said apparatus comprising:

first and second hasps for mounting on the respective first and second parts and formed with respective first and second mounting flanges and first and second hasp plates arranged to, when mounted on such parts, project coextensive to one another, said first hasp plate being formed with a first capture leg-receiving bore larger than such predetermined diameter and said second hasp plate being formed with a second capture leg-receiving bore aligned therewith, said first and second hasp plates being formed with respective first pivot leg-receiving slots for receiving such pivot leg when said capture leg is received in said capture leg-receiving bores such that said mounting plates of said first and second hasps may be mounted on said respective first and second parts with the opposed surfaces of said plates spaced a specified distance apart, which distance is less than said predetermined distance; and guard plate means mounted on said first or first and second hasp plates and extending perpendicular in one direction from said first hasp plate a first guard distance sufficient to, when combined with said specified distance, at least equal the distance said shackle, when locked, projects from such top surface of the padlock body, and projecting in the direction opposite said one direction a second guard distance beyond said second plate, said second guard distance being at least equal to, when combined with said specified distance, said predetermined distance whereby said first and second hasps may be mounted on said parts with said opposed surfaces spaced apart said specified distance and said closure leg of said shackle inserted in said closure bores with said pivot leg received in said slots such that said plate means blocks access to said shackle.

2. Padlock hasp apparatus as set forth in claim 1 wherein:

said guard plate means is mounted on said first hasp plate and includes a first guard plate projecting in said one direction and a second guard plate projecting in said opposite direction.

3. Padlock hasp apparatus as set forth in claim 1 wherein:

said first and second hasp plates project perpendicular to the respective first and second mounting plates.

4. Padlock hasp apparatus as set forth in claim 1 for use with a padlock including a shackle formed such that, when said shackle is open and fully extended, the distance between said bearing point and such top surface forms a predetermined open distance and wherein:

said second guard plate is formed with said second guard distance less than said predetermined open distance such that, when said closure leg is inserted in said bores with said shackle open and fully extended such padlock body may be rotated relative to such pivot leg and will clear said second guard plate.

5. Padlock hasp apparatus as set forth in claim 1 for use with a padlock having a body of a predetermied width wherein:

said mounting and guard plates project perpendicular to one another and first guard plate angles toward said first mounting flange as it projects away from said first hasp plate to terminate in an edge spaced a distance from said first mounting plate less than said predetermined width from said mounting plate.

6. Padlock hasp apparatus as set forth in claim 1 wherein:

said guard plate means is of unitary construction and projects between said first and second hasp plates to block access to the space between said first and second hasp plates.

7. Padlock hasp apparatus as set forth in claim 1 wherein:

said first and second hasp plates are formed with said first and second pivot leg-receiving slots open to the side of the respective plates opposite the respective bores.

8. Padlock hasp apparatus as set forth in claim 1 wherein:

said first hasp is generally U-shaped in cross section to form said first mounting flange and first guard plate.

9. Padlock hasp apparatus as set forth in claim 1 wherein:

said second hasp is generally U-shaped to form said second mounting flange and guard plate projecting perpendicular to one another.

10. Padlock hasp apparatus as set forth in claim 1 wherein:

said second hasp is formed with a guard tab projecting, when said hasps are mounted, in overlying relation past one edge of said first hasp plate to block access to the space between said hasp plates.

11. Padlock hasp apparatus as set forth in claim 1 wherein:

said second hasp plate is formed with spacer dimple means projecting from said opposed surface to, when said padlock is in its locked condition, engage said top surface and limit travel of said body toward said second hasp plate.

12. Padlock hasp apparatus as set forth in claim 1 wherein:

said guard plate means projects around two sides of said hasps.

13. Padlock hasp apparatus as set forth in claim 1 for use with a padlock having a body of a predetermined width and wherein:

said openings are in the form of open ended slots opening away from said bores and having respective widths greater than said predetermined width.

14. Padlock hasp apparatus as set forth in claim 1 for use with a padlock including a body of a predetermined width and length and wherein:

said second guard plate is so configured and arranged relative to said second mounting flange as to cooperate therewith in forming a passage greater than such predetermined width but less than such predetermined length such that the top portion of such body may be received in said cavity and with such top portion received therein, when said padlock is closed, said second guard plate will block said padlock body against full rotation about said closure leg.

15. Padlock hasp apparatus for receiving a padlock having a shackle for locking first and second parts together and including:

first and second hasps formed with respective first and second mounting plates and respective first and second hasp plates arranged such that said first and second hasps may be mounted in positions on said first and second parts with said plates extending coextensive with one another, said first and second plates being formed on their respective one ends with respective first and second aligned bores for receiving the closure leg of such shackle and formed at their respective opposite ends with slot means for receiving the pivot leg of such shackle, said closure leg bores being so arranged as to, when such shackle is locked to the padlock, limit longitudinal travel of such closure leg to define the path of travel for such shackle; and guard plate means mounted on one of said first or first and second hasp plates and projecting longitudinally thereof a distance coextensive with said path of such shackle when in its locked position whereby such guard plate means will block access to such shackle.

* * * * *